United States Patent [19]

Hruda

[11] Patent Number: 4,537,662

[45] Date of Patent: Aug. 27, 1985

[54] METHOD OF ELECTRICALLY SHORTING AN ELECTROLYTIC CELL

[75] Inventor: Robert M. Hruda, Horseheads, N.Y.

[73] Assignee: Westinghouse Electric Corp., Pittsburgh, Pa.

[21] Appl. No.: 607,098

[22] Filed: May 4, 1984

[51] Int. Cl.[3] ..... C25G 15/02

[52] U.S. Cl. ..... 204/1 R; 204/228; 204/98; 204/128

[58] Field of Search ..... 204/98, 128, 228, 1 R

[56] References Cited

U.S. PATENT DOCUMENTS 4,324,634 4/1982 Kircher et al. ..... 204/228

4,370,530 1/1983 Wayland ..... 204/228

*Primary Examiner*—R. L. Andrews

*Attorney, Agent, or Firm*—C. L. Menzemer

[57] ABSTRACT

A method for electrically shorting a high current, low voltage, single, chloralkali, membrane, electrolytic cell of a certain configuration to permit first its removal from a system, comprised of a plurality of electrically series connected cells, for maintenance purposes and then its return to the system. The method comprises first employing an electrical jumper circuit, comprised of two sets of bus bars and a switch, to electrically short out two adjacent cells, one of which is to be removed from the system to undergo maintenance, and then to modify the circuit in situ to enable the shorted cell adjacent to the cell to be removed to be returned to the system almost immediately.

6 Claims, 3 Drawing Figures

METHOD OF ELECTRICALLY SHORTING AN ELECTROLYTIC CELL

BACKGROUND OF THE INVENTION

1. Field of the Invention

The present invention is generally in the field of membrane type, chloralkali, electrolytic cells and is directed specifically to the electrical circuitry employed to remove such a cell from a system comprised of a plurality of such cells.

2. Description of the Prior Art:

The prior art methods for removing an electrolytic cell from a system for servicing or maintenance have all required electrically shorting out two cells, the one to be serviced and an immediately adjacent cell and leaving both cells out of the system during the maintenance operation.

The prior art is typified by the following U.S. Pat. Nos.: 4,390,763; 4,324,634; 4,317,708; 4,302,642; 4,251,334; and 4,227,987, none of which teach the process taught and claimed in the present invention.

SUMMARY OF THE INVENTION

The present invention comprises a method for electrically shorting an electrolytic cell from a system comprised of a series of electrolytic cells, said cells each having conductor bars of a first polarity disposed along a top surface of the cell and conductor bars of a second polarity disposed along a bottom surface of the cell, said cells in the system being electrically connected in a series circuit relationship by bus bars connecting the conductor bars of the second type polarity on one cell to the conductor bars of the first type polarity on the adjacent cell, said method comprising disposing a jumper circuit above a first cell, said first cell to be electrically shorted from the system, and a second cell, said second cell being adjacent to said first cell, said second cell being electrically connected to said first cell by the bus bars electrically connected to the conductor bars of said second polarity of said second cell and conductor bars of said first polarity of said first cell, said jumper circuit being comprised of a first bus bar and a second bus bar, said first and second bus bars being connected electrically in series by a switch, electrically connecting the conductor bar of said first polarity of said second cell to said second bus bar of said jumper circuit, electrically connecting the conductor bar of said first polarity of a third cell to said first bus bar of said jumper circuit, said third cell being disposed adjacent to said first cell on the side of said first cell opposite to said second cell, closing the switch of the jumper circuit whereby said first and second cells are electrically shorted from said system, disconnecting at said first cell the bus bar connected between the conductor bar of said second polarity of said second cell and the conductor of said first polarity of said first cell, disconnecting at said first cell the bus bar connected between the conductor bar of said second polarity of said first cell and the conductor bar of said first polarity of said third cell, physically connecting the bus bar which was disconnected from the conductor bar, of said first polarity, of the first cell to a terminal of the switch in the jumper circuit and opening the switch in the jumper circuit.

BRIEF DESCRIPTION OF THE DRAWINGS

For a better understanding of the nature of the present invention, reference should be had to the following detailed discussion and drawings in which.

DESCRIPTION OF THE PREFERRED EMBODIMENT

Figure 1:
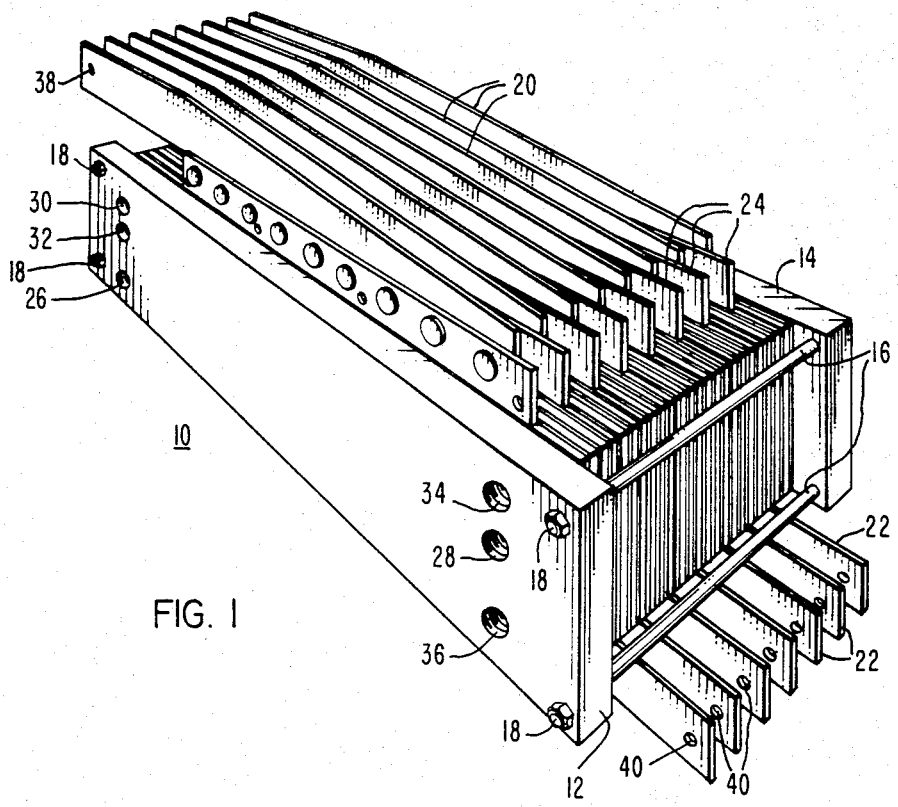
FIG. 1 is an isometric view of a typical electrolytic cell used in conjunction with the teaching of this invention.

With reference to FIG. 1, there is shown a high, direct current, low voltage, chloralkali, membrane, electrolytic cell 10 of the type used in conjunction with the teachings of this invention.

An example of the cell 10 is one developed by ICI and marketed commercially by Chemetics International Ltd., Vancouver, B.C., Canada under the designation FM21.

The cell 10 has a front end plate 12 and a back end plate 14 tied together by tie rods 16 and nuts 18.

The space between the front and back end plates 12 and 14 is filled with alternate layers of gaskets, membranes and electrodes.

Electrical current is introduced into the cell 10 by anode copper bus conductor bars 20 and cathode copper bus conductor bars 22 which in turn are bolted or riveted to electrodes such as anode electrodes 24 and cathode electrodes not shown which extend into the cell between the end plates 12 and 14.

Feed brine is introduced into the cell 10 through aperture 26 and removed through aperture 28.

Hydrogen is removed from the cell 10 through aperture 30 and strong caustic soda is removed from the cell 10 through aperture 32. Chlorine and weak caustic soda is removed from the cell 10 through apertures 34 and 36, repectively.

Each of the anode copper bus conductor bars 20 and each of the cathode copper bus conductor bars 22 have apertures 39 and 40, respectively, therethrough to facilitate connecting the cell 10 to additional cells eletrically in series to form a system of cells.

Figure 2:
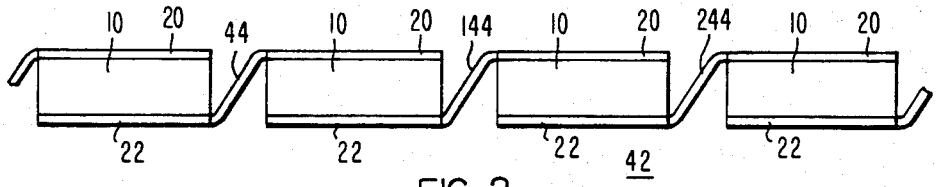
FIG. 2 is a schematic diagram of an electrolytic cell line.

With reference to FIG. 2, there is shown schematically a system 42 comprised of a plurality of cells 10 connected electrically in series.

The copper cathode conductor bus bar 22 of one cell 10 is connected to the copper anode conductor bus bar 20 of the next cell in line by flexible copper buses 44, 144 and 244. Thus the cells 10 in the system are connected electrically in a series circuit relationship.

The physical electrical connection of the flexible copper buses 44 to the anode electrodes 20 and the cathode electrodes 22 is effected by bolting flexible copper bus to each of the anode and cathode bus bars utilizing the apertures 38 and 40 in the anode and cathode bus bars.

A cell of the type shown in FIG. 1 and referred to above may normally carry from 50,000 to 150,000 amps and 3 to 4 volts during operation.

The number and size of anode and cathode bus conductor bars 20 and 22, respectively, is a function of the current flowing through the cell 10 during operation.

The number and size of the flexible copper buses is also a function of the current flowing through each cell during operation.

For a cell operating at 150,000 amps, 40 to 60 flexible copper buses approximately 1 inch thick and 2 inches wide are required to interconnect one cell to the next adjacent cell.

Figure 3:
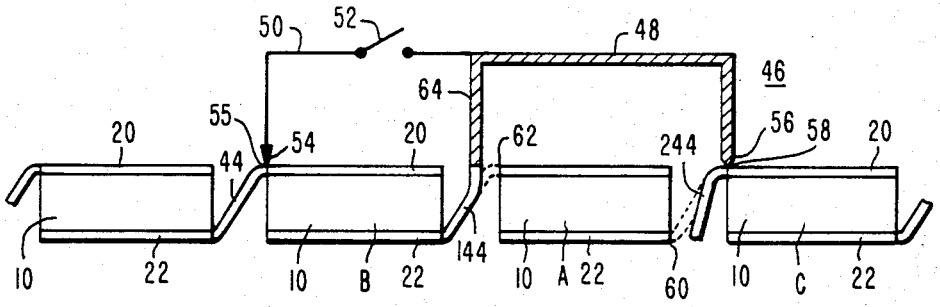
FIG. 3 is a schematic diagram of a jumper circuit disposed over the line of FIG. 2.

With reference to FIG. 3, assume cell A is to be removed from the system for maintenance.

A jumper circuit 46 is positioned above cell A, the cell to be removed for maintenance, and cell B which is the cell immediately adjacent to cell A. The jumper circuit could also be positioned along side or even below the cell system.

The jumper circuit 46 is one embodiment, and as shown schematically in FIG. 3, is comprised of two sets of bus bars 48 and 50 electrically connected in a series circuit relationship by a switch 52.

The set of bus bars 48 in this embodiment is intended to carry the current, for example 150,000 amps, from cell B to cell C during the entire time cell A is out of system undergoing maintenance while the set of bus bars 50 will only carry the 150,000 amps of current for a relatively short time, i.e., thirty minutes. That is, only during the time necessary to remove cell A physically from the system. Therefore, the bus bars 48 are comprised of more copper than the bus bars 50. For example, the cross-sectional area of the bus bar 48 will be about 120 square inches while the cross-sectional area of the bus bar 50 will be about 75 square inches.

The 120 and 75 square inches respectively presuppose convection cooling of the bus bars, if water cooling is employed the cross-sectional area can be reduced for both bus bars. For example, the bus bar 48 can be reduced to approximately 50 to 75 square inches and the bus bar 50 can be reduced to approximately 40 to 60 square inches.

It should be understood that while bus bars 48 and 50 can be comprised of a single bar, the more common practice would be for both bus bars 48 and 50 to be comprised of several copper bars. In such a case, the cross-sectional areas set forth above would be the sum total of the several bus bars.

The switch 52 may be any suitable switch known to those skilled in the art.

A preferred switch is that taught and claimed in U.S. Pat. No. 4,390,763, Electrochemical Cell Shunting Switch Assembly with Matrix Array of Switch Modules, issued June 28, 1983, the inventor and assignee of which are the same as in the present invention. The teachings of U.S. Pat. No. 4,390,763 are incorporated herein by reference.

In a second embodiment of the circuit 46, the bus bar 50 is of the same cross-sectional area as the bus bar 48.

In practicing the method of this invention, the circuit 46, mounted on a buggy is moved into position over the cells A and B.

Terminal 54 of jumper circuit 46 is electrically connected to flexible bus 44 coming into cell B at the point 55 where flexible bus 44 is connected to anode contact 20.

Terminal 56 of jumper circuit is electrically connected to flexible bus 244 coming into cell C at point 58 where flexible bus 244 is connected to anode contact 20 of cell C.

The switch 52 is then closed, electrically shorting out cells B and C. That is, the electrical current is shunted through the jumper circuit 46.

Flexible bus 244 is then disconnected from cathode contact 22 of cell A at point 60.

Flexible bus 144 is disconnected from anode contact 20 of cell A at point 62 and electrically connected to terminal 64 of jumper circuit 46. The terminal 64 of the jumper circuit may be a terminal of switch 52.

Dotted lines are used in FIG. 3 to show where flexible buses 144 and 244 had been connected before being disconnected.

The switch 52 is then opened as shown in FIG. 3 and the cell A is removed for servicing.

It should be noted that the current shorted from the cells A and B flowed through bus bars 50 only long enough for the cell A to be physically disconnected from the system, in practice this time is about 30 minutes. Thus the bus bars 50, as pointed out above, can be of less copper than the bus bars 48 which carry the current load during the entire time that the cell A is undergoing maintenance.

When cell A has been refurbished it is returned to the line by simply reversing the procedure followed in its removal.

That is, the switch 52 is closed thereby shunting the current through the bus bars 48 and 50.

The flexible buses 144 and 244 are then reconnected to cells A and B, respectively.

The switch 52 is opened and the terminals 54 and 56 are disconnected.

The present invention provides several advantages over prior art procedures.

Only one cell, the cell actually undergoing maintenance, is off line during the maintenance period. The cell adjacent to the cell being removed is off line only long enough to make the necessary electrical connections. This is equivalent to having an extra cell on line during maintenance.

The jumper or shorting switch only requires full load bus capacity for approximately the length of one cell, i.e., bus 48, the remainder of the bus bar, 50, of the jumper switch 46 can be comprised of approximately one-half full load capacity. This is a substantial saving in size, weight and copper.

Fewer switch contact elements are required due to the short duration of load conduction.

There is no danger of an accidental switch opening while a cell is out of the line.

I claim as my invention:

1. A method for electrically shorting an electrolytic cell from a system comprised of a series of electrolytic cells, said cells each having conductor bars of a first polarity disposed along a top surface of the cell and conductor bars of a second polarity disposed along a bottom surface of the cell, said cells in the system being electrically connected in a series circuit relationship by bus bars connecting the conductor bars of the second type polarity on one cell to the conductor bars of the first type polarity on the adjacent cell, said method comprising disposing a jumper circuit adjacent a first cell, said first cell to be electrically shorted from the system, and a second cell, said cell being adjacent to said first cell, said second cell being electrically connected to said first cell by the bus bars electrically connected to the conductor bars of said second polarity of said second cell and conductor bars of said first polarity of said first cell, said jumper circuit being comprised of a first bus bar and a second bus bar, said first and second bus bars being connected electrically in series by a switch, electrically connecting the conductor bar of said first polarity of said second cell to said second bus bar of said jumper circuit, electrically connecting the conductor bar of said first polarity of a third cell to said first bus bar of said jumper circuit, said third cell being disposed adjacent to said first cell on the side of said first cell opposite to said second cell, closing the switch of the jumper circuit whereby said first and second cells are electrically shorted from said system, disconnecting at said first cell the bus bar connected between the conductor bar of said second polarity of said second cell and the conductor bar of said first polarity of said first cell, disconnecting at said first cell the bus bar connected between the conductor bar of said second polarity of said first cell and the conductor bar of said first polarity of said third cell, physically connecting the bus bar which was disconnected from the conductor bar, of said first polarity, of the first cell to a terminal of the switch in the jumper circuit and opening the switch in the jumper circuit.

2. The method of claim 1 in which the jumper circuit is positioned above the cell to be removed and the adjacent cell.

3. The method of claim 1 in which electrical current is shunted through said second bus bar of said jumper circuit only during the time required to electrically disconnect the first cell from the system.

4. The method of claim 2 in which electrical current is shunted through said first bus bar of said jumper circuit during the entire time the first cell is out of the system.

5. The method of claim 1 in which said conductor bars of a first polarity are anode conductor bars and said conductor bars of a second polarity are cathode conductor bars.

6. The method of claim 1 in which the buses connecting the cells electrically in series are flexible.

* * * * *